US011248572B2

(12) United States Patent
Schenck Zu Schweinsberg et al.

(10) Patent No.: US 11,248,572 B2
(45) Date of Patent: Feb. 15, 2022

(54) FUEL DISTRIBUTOR FOR INTERNAL COMBUSTION ENGINES

(71) Applicant: Robert Bosch GmbH, Stuttgart (DE)

(72) Inventors: Alexander Schenck Zu Schweinsberg, Moeglingen (DE); Klaus Joos, Walheim (DE); Markus Amler, Leonberg-Gebersheim (DE); Michael Bauer, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/959,038

(22) PCT Filed: Feb. 1, 2019

(86) PCT No.: PCT/EP2019/052464
§ 371 (c)(1),
(2) Date: Jun. 29, 2020

(87) PCT Pub. No.: WO2019/185218
PCT Pub. Date: Oct. 3, 2019

(65) Prior Publication Data

US 2020/0340436 A1 Oct. 29, 2020

(30) Foreign Application Priority Data

Mar. 28, 2018 (DE) ..... 102018204702

(51) Int. Cl.
*F02M 55/00* (2006.01)
*F02M 55/04* (2006.01)
(Continued)

(52) U.S. Cl.
CPC ..... *F02M 55/025* (2013.01); *F02M 55/04* (2013.01); *F02M 63/0275* (2013.01); *F02M 2200/315* (2013.01)

(58) Field of Classification Search
CPC .. F02M 55/025; F02M 55/04; F02M 63/0275; F02M 2200/315
(Continued)

(56) References Cited

U.S. PATENT DOCUMENTS 6,443,131 B1 * 9/2002 Bueser ..... F02M 37/0041 123/456
6,848,477 B2 * 2/2005 Treusch ..... F02M 37/0041 138/44
(Continued)

FOREIGN PATENT DOCUMENTS

DE 102014205179 A1 9/2015

OTHER PUBLICATIONS

International Search Report for PCT/EP2019/052464, dated Apr. 5, 2019.

*Primary Examiner* — Erick R Solis
(74) *Attorney, Agent, or Firm* — Norton Rose Fulbright US LLP; Gerard Messina

(57) ABSTRACT

A fuel distributor, which is in particular used as a fuel distribution rail for mixture-compressing, spark-ignited internal combustion engines, including a base body, at which at least one high-pressure inlet and multiple high-pressure outlets are provided. An insert element is furthermore provided that is situated in an interior of the base body. In the interior, the insert element separates an inflow area, which extends from the high-pressure inlet to the high-pressure outlets, at least essentially from a damping area. The insert element is designed as a thin-walled insert element that forms a divider extending through the interior at least from the high-pressure inlet to the high-pressure outlets.

9 Claims, 3 Drawing Sheets

(51) Int. Cl.
*F02M 55/02* (2006.01)
*F02M 63/02* (2006.01)

(58) Field of Classification Search
USPC ..... 123/456, 468
See application file for complete search history.

(56) References Cited

U.S. PATENT DOCUMENTS

| | | | | |
|---|---|---|---|---|
| 7,146,700 | B1 * | 12/2006 | Darrah | B21D 26/033 29/419.2 |
| 7,520,268 | B1 * | 4/2009 | Sims, Jr. | F02M 55/025 123/447 |
| 8,458,904 | B2 * | 6/2013 | Zdroik | F02M 55/025 29/890.14 |
| 2003/0084879 | A1 * | 5/2003 | Treusch | F02M 69/465 123/456 |
| 2005/0133008 | A1 | 6/2005 | Zdroik et al. | |
| 2005/0178363 | A1 * | 8/2005 | Bruehmann | F02M 55/005 123/467 |
| 2011/0057017 | A1 | 3/2011 | Zdroik et al. | |
| 2017/0234282 | A1 * | 8/2017 | Wang | F02M 55/04 123/294 |
| 2019/0353126 | A1 * | 11/2019 | Gerundt | F02M 63/0275 |

* cited by examiner

FUEL DISTRIBUTOR FOR INTERNAL COMBUSTION ENGINES

FIELD

The present invention relates to a fuel distributor, in particular a fuel distribution rail for mixture-compressing, spark-ignited internal combustion engines. The present invention specifically relates to the field of fuel injection systems of motor vehicles in which fuel is injected directly into the combustion chambers of an internal combustion engine.

BACKGROUND INFORMATION

A fuel distribution rail for an internal combustion engine is described in German Patent Application No. DE 10 2014 205 179 A1. The conventional fuel distribution rail has an elongated housing including a hollow space, a fuel inflow into the hollow space, and at least two fuel outflows out of the hollow space for each of the fuel injectors. In the hollow space, a body is situated which includes a groove that connects the two fuel outflows to one another and a groove that radially surrounds the body in the area of the fuel inflow. The body having the two grooves is used as an insert, using which a direct inflow of the fuel from a pump to the injectors is ensured, this body potentially having an inside volume which is used for damping, but is not located in the direct fuel flow.

The fuel distribution rail described in German Patent Application No. DE 10 2014 205 179 A1 has the disadvantage that the manufacturing process of the insert is complex, since it is designed as a thick-walled tube having grooves. Furthermore, the conventional fuel distribution rail is limited to a radial inflow of the fuel, thus resulting in a delimited range of applications.

SUMMARY

An example fuel distributor according to the present invention may have the advantage that an improved design and operating mode are made possible. In particular, a cost-effective and/or easily manufacturable option may be implemented in order to provide for an improved injection in combination with good damping behavior.

With the aid of the measures described herein, advantageous refinements of the fuel distributor according to the present invention are possible.

In accordance with the present invention, the provided fuel distributor is suitable in particular for injecting a mixture; the mixture composition is to vary during operation. In particular, a direct water injection may be implemented in which water in an emulsion with at least one type of fuel, in particular gasoline, is injected into the combustion chambers of an internal combustion engine. In this case, the water is supplied to the fuel upstream from or in a high-pressure pump and is conveyed together with the fuel to the high-pressure injectors via the fuel distributor.

The composition of the mixture, in particular of the emulsion, may vary during operation. For example, it is possible that the addition of water is necessary or desirable only in a certain area of the characteristic map. For example, it is possible that water or a larger water content may be desirable at a high rotational speed and/or at a high load. When this area of the characteristic map is left, for example in the case of a coasting cutoff, it is advantageous for the injected water content to be able to be rapidly reduced and, in particular, to rapidly go toward zero. For this purpose, a short delay period is necessary between the addition of the water upstream from or in the high-pressure pump and the injection of same via the high-pressure injectors. In principle, the volume of the fuel distributor has an increasing effect on this delay period. By subdividing the interior of the base body into an inflow area and a damping area it is possible, however, to shorten the delay period, while maintaining the damping, in particular the damping of the pressure pulsations. The insert element may be used to keep the hydraulic volume between the high-pressure inlet and the two or more high-pressure outlets small, while implementing a larger hydraulic damping volume.

The insert element is advantageously designed as a thin-walled insert element, thus resulting in low manufacturing costs. Here, a simple and cost-effective adaptation of a given high-pressure hydraulic system is possible with regard to implementing a direct water injection. Here, an adaptation to the different requirements, in particular a connection of the high-pressure line in a radial or axial manner, may further take place, if the base body is designed as a tubular base body.

With the aid of the refinement of the present invention, a subdivision of the interior may advantageously take place. Here, a connection to the damping area may take place outside of the inflow area. Additionally or alternatively, it is possible in a further refinement of the present invention that suitable through-openings are provided at the insert element to connect the inflow area at least locally to the damping area. Depending on the application, a damping behavior, in particular with regard to pressure pulsations, may thus be improved. By designing the base body as a tubular base body, in particular, pressure pulsations occurring during switching of a fuel injector whose high-pressure outlet is close to the high-pressure inlet may thus be effectively dampened. Corresponding advantages result in refinements of the present invention.

Another refinement according to the present invention may have the advantage that a cost-effective and reliable fastening of the insert element in the base body is made possible. Additionally or alternatively, a further refinement according to the present invention may have the advantage that an additional safeguard against a displacement, in particular a twisting, of the insert element is implemented during operation.

In a further refinement according to the present invention, a sufficient separation between the inflow area and the damping area may potentially be achieved already with the aid of a geometric design of the insert element. Another refinement according to the present invention may have the advantage that a small volume of the inflow area may be implemented. Furthermore, interfering influences of the insert element on the flow behavior in the inflow area, for example, may be minimized.

Advantageous possibilities of implementing an axial or radial high-pressure connection at the base body are also described herein.

BRIEF DESCRIPTION OF THE DRAWINGS

Preferred exemplary embodiments of the present invention are explained in greater detail in the following description with reference to the figures in which corresponding elements are provided with matching reference numerals.

DETAILED DESCRIPTION OF EXAMPLE EMBODIMENTS

Figure 1:
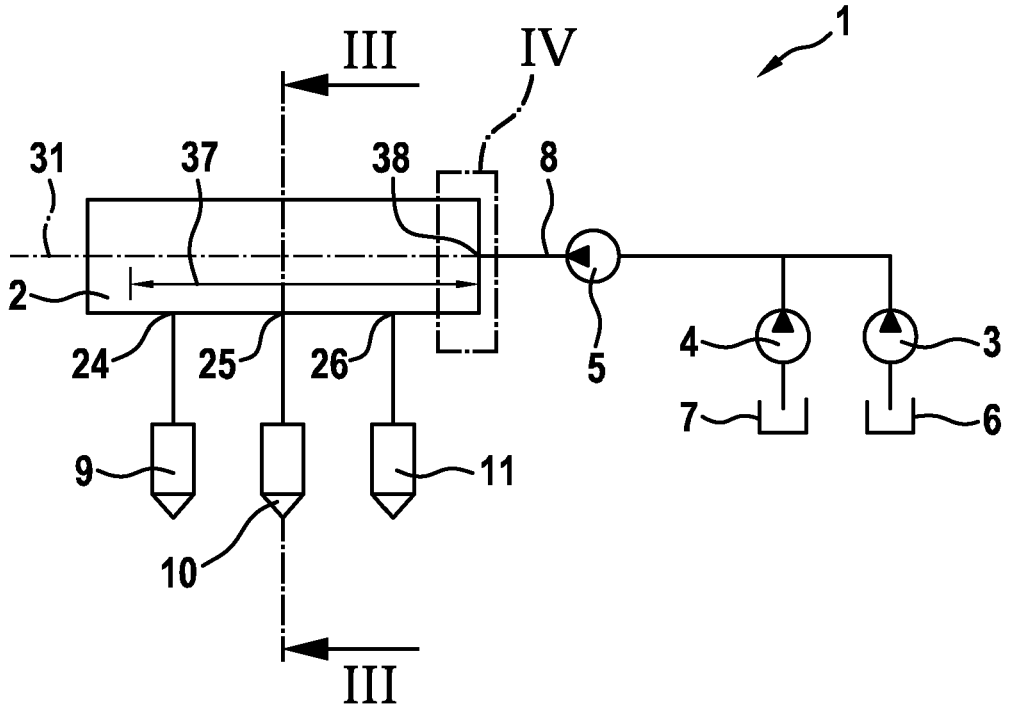
FIG. 1 shows a fuel injection system including a fuel distributor in a schematic illustration according to a first exemplary embodiment of the present invention.

FIG. 1 shows a fuel injection system 1 including a fuel distributor 2 in a schematic illustration according to a first exemplary embodiment. In this exemplary embodiment, fuel injection system 1 includes a fuel pump 3 and a metering unit 4 that is designed as a backing pump 4. Furthermore, a high-pressure pump 5 is provided. Fuel pump 3 conveys liquid fuel from a tank 6 to high-pressure pump 5. Metering unit 4 is used to intermittently meter water from a reservoir 7 into the conveyed fuel. In this exemplary embodiment, the metering takes place upstream from high-pressure pump 5. In one modified embodiment, the metering may also take place at high-pressure pump 5. In a line section 8 provided between fuel distributor 2 and high-pressure pump 4, the liquid fuel or a mixture of the liquid fuel and water is conveyed depending on the operating state. Here, the water content in the mixture may be fixedly predefined or also vary over time depending on the embodiment.

Fuel distributor 2 is used to store and distribute fuel among fuel injectors 9, 10, 11 and thus reduces the pressure fluctuations or pulsations. Fuel distributor 2 may also be used to dampen pressure pulsations which may occur when fuel injectors 9 through 11 are switched. Fuel distributor 2 is designed in such a way that when metering unit 4 is switched on or off, for example, a short delay period is achieved with regard to adding the water upstream from high-pressure pump 5 and the injecting the water via fuel injectors 9 through 11.

Figure 2:
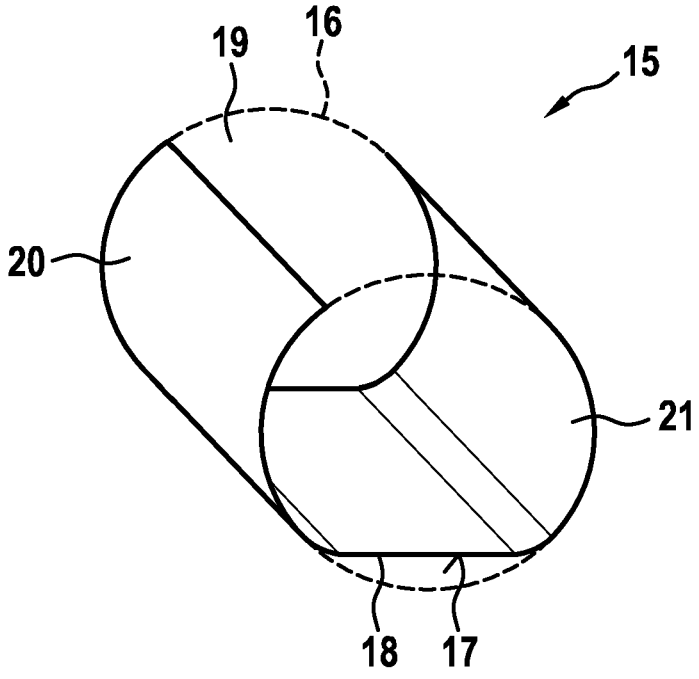
FIG. 2 shows an insert element for the fuel distributor shown in FIG. 1 in a schematic, spatial illustration.

FIG. 2 shows an insert element for fuel distributor 2 shown in FIG. 1 in a schematic, spatial illustration. Here, insert element 15 may be based on a cylindrical jacket-shaped basic shape 16 which is illustrated with dashed lines. In this exemplary embodiment, a flattened side 17, at which a thin-walled divider 18 is formed, is implemented starting from cylindrical jacket-shaped basic shape 16. In particular, the entire cylindrical jacket-shaped basic shape 16 may be predefined to be thin-walled. Thin-walled divider 18 may in particular be designed to be cuboid-shaped. Furthermore, insert element 15 has a recess 19 that faces away from flattened side 17 and that divides cylindrical jacket-shaped basic shape 16 at recess 19. Here, outer sides 20, 21 remain that are connected to one another only for thin-walled divider 18 in this exemplary embodiment. In this case, outer sides 20, 21 lie geometrically preferably in cylindrical jacket-shaped basic shape 16. Outer sides 20, 21 are preferably thin-walled.

Figure 3:
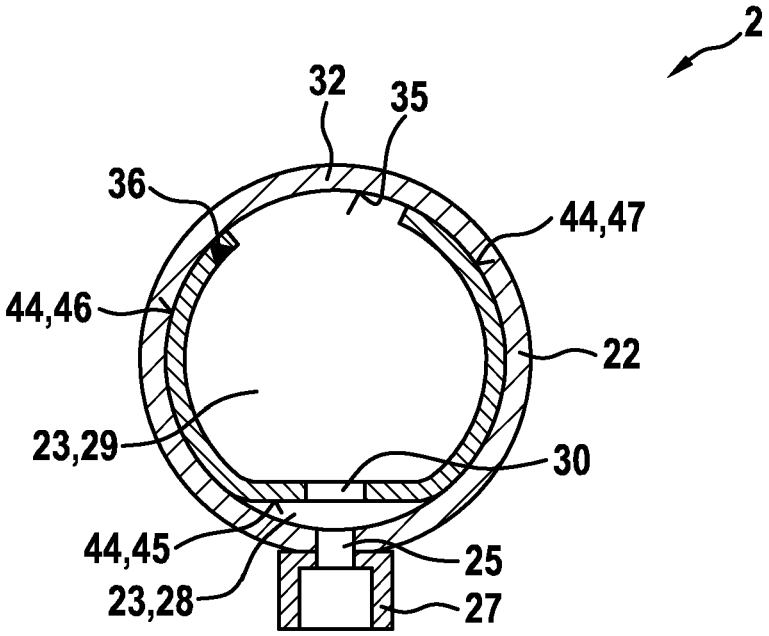
FIG. 3 shows a schematic section along the section line denoted by III through the fuel distributor shown in FIG. 1 according to one possible embodiment.

FIG. 3 shows a schematic section along the section line denoted by III through fuel distributor 2 shown in FIG. 1 according to one possible embodiment. Fuel distributor 2 has base body 22 that is designed as a tubular base body 22 in this exemplary embodiment. An interior 23 of fuel distributor 2 is formed in base body 22. In the assembled state, insert element 15 is situated in interior 23. In this case, flattened side 17 and thin-walled divider 18 face high-pressure outlets 24, 25, 26 for fuel injectors 9 through 11, high-pressure outlet 25 of which being illustrated in FIG. 3. High-pressure connection 27, which is designed as a cup 27, is provided at high-pressure outlet 24, for example.

Insert element 15 divides interior 23 into an inflow area 28 and a damping area 29. Here, inflow area 28 and damping area 29 are preferably locally connected to one another. In this exemplary embodiment, through-openings 30, at which inflow area 28 is locally connected to damping area 29, are provided at insert element 15 in the area of high-pressure outlets 24 through 26, through-opening 30 being illustrated in FIG. 3 for high-pressure outlet 25.

In this exemplary embodiment, divider 18 formed by insert element 15 thus separates inflow area 28 from damping area 29 in inflow area 28 in a profile 32 viewed perpendicularly to a longitudinal axis 31 of base body 22, a connection via through-openings 30 being possible. Inflow area 28 may thus be used as an emulsion-guiding area 28, when metering unit 4 is actuated. When metering water into the supplied fuel, damping area 29 remains at least essentially a pure gasoline area 29 in this case. A great volume is thus available for damping the pressure. Since insert element 15 is subjected only to those pressure differences through remaining pulsations that are considerably lower than typical working pressures, a thin-walled design of insert element 15 is possible. Insert element 15 may be in particular formed from a thin-walled sheet metal.

Insert element 15 is preferably formed in such a way that it rests close and under pressure at an inner wall 35 of base body 22 of fuel distributor 2. As an additional safeguard against a twisting of insert element 15 during operation, one or multiple connections 36 may be provided, at which insert element 15 is connected at least locally to inner wall 35 of base body 22. Such connections 36 may be implemented through spot welds 36 and/or welding seams 36 and/or through form-locked connections 36, for example. It is thus ensured that no high-pressure outlet 24 through 26 is closed or inadmissibly throttled.

Through-openings 30 may be implemented through bores, cutouts, or the like, for example. In a modified embodiment, axial or radial distances may be additionally or alternatively provided between insert element 15 and inner wall 35 of base body 22, to allow for a connection between inflow area 28 and damping area 29.

An advantageous separation between inflow area 28 and damping area 29 may also be achieved in that insert element 15 is formed in such a way that, in the assembled state, it is situated in interior 23 under a pre-tension applied against inner wall 35 of base body 22. Insert element 15 may be in particular designed in such a way that it at least predominantly rests at inner wall 35 at least at inflow area 28. For example, this may be implemented with the aid of a section 37 that extends from a high-pressure inlet 38 to at least high-pressure outlet 24, which is spaced apart the farthest from high-pressure inlet 38.

In one modified embodiment, insert element 15 may also extend along longitudinal axis 31, for example, viewed only across section 37 that predefines inflow area 28 extending from high-pressure inlet 38 to high-pressure outlets 24 through 26.

Figure 4:
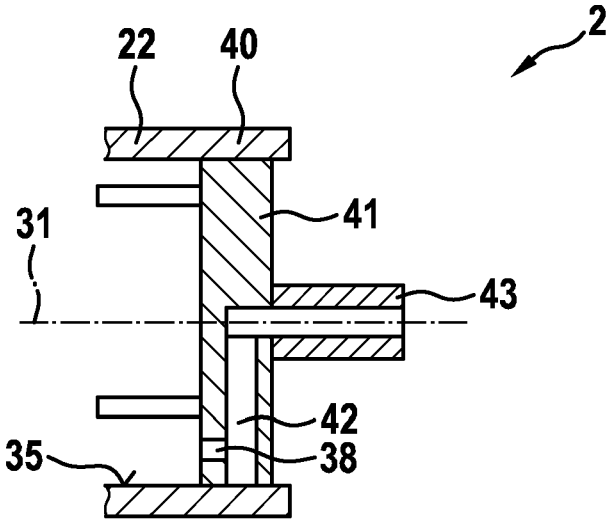
FIG. 4 shows an excerpt from a schematic sectional illustration of the section of the fuel distributor denoted by IV in FIG. 1.

FIG. 4 shows an excerpt from a schematic sectional illustration of the section of fuel distributor 2 denoted by IV in FIG. 1. In this exemplary embodiment, an end piece 41 is situated, for example, at an end 40 of tubular base body 22. End piece 41 has an eccentric fuel guidance 42. In this way, a high-pressure connection 43 may be situated at least approximately on longitudinal axis 31, for example, while high-pressure inlet 38 may be positioned more closely or closely to inner wall 35 of base body 22. Eccentric fuel guidance 42 and/or high-pressure inlet 38 may be designed in this case in such a way that a predefined throttling effect is implemented. A cross section, in particular a diameter, of eccentric fuel guidance 42 and/or a cross section, in particular a diameter, of high-pressure inlet 38 may be designed at least sectionally to have a reduced diameter. A small volume of inflow area 28 may be implemented in particular in combination with an eccentric fuel guidance 42. As illustrated in FIG. 3, it is also advantageous for this purpose, if an outer side 44, which faces inflow area 28 in one part 45, faces inner wall 35 of base body 22 in parts 46, 47. This molding or bending of insert element 15 makes a small volume of inflow area 28 possible in combination with a stable and consistent positioning in base body 22.

Figure 5:
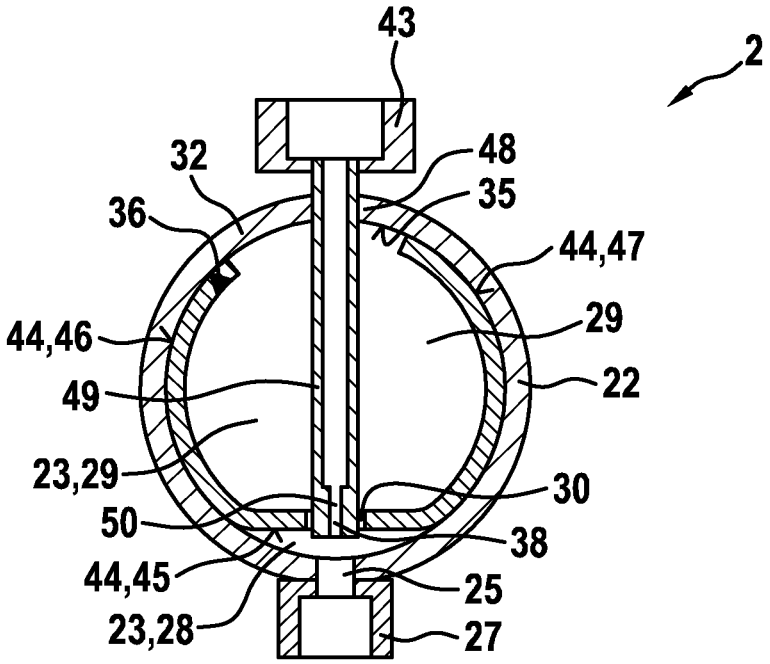
FIG. 5 shows the section through a fuel distributor illustrated in FIG. 3 according to a second exemplary embodiment.

FIG. 5 shows the section through a fuel distributor 2 illustrated in FIG. 3 according to a second exemplary embodiment. In this exemplary embodiment, a high-pressure connection 43 is located at wall spot 48 of base body 22 that is adjacent to damping area 29. In this case, a fuel line 49 is provided that extends through damping area 29 and connects high-pressure connection 43 to a high-pressure inlet 38 of inflow area 28. Fuel line 49 extends through damping area 29, so that a radial positioning of high-pressure connection 43 is possible at tubular base body 22. In this case, a throttle 50 that dampens the hydraulic oscillations in fuel line 49 may be designed in fuel line 49. In this exemplary embodiment, throttle 50 is provided at high-pressure inlet 38.

The present invention is not limited to the described exemplary embodiments.

What is claimed is:

1. A fuel distributor, comprising:

a base body having at least one high-pressure inlet and multiple high-pressure outlets; and at least one insert element that is situated in an interior of the base body, the insert element separating, in the interior, an inflow area, which extends from the high-pressure inlet to the high-pressure outlets, from a damping area;

wherein the insert element is a thin-walled insert element that forms a divider extending through the interior at least from the high-pressure inlet to the high-pressure outlets, wherein the insert element is formed in such a way that, in an assembled state, the insert element is situated in the interior of the base body under a pre-tension applied against an inner wall of the base body, wherein at least one through-opening, at which the inflow area is connected to the damping area, is provided at the insert element in an area of the high-pressure outlets, wherein a high-pressure connection is situated at a wall point of the base body adjacent to the damping area and a fuel line is provided that extends through the damping area and at least to the insert element and that connects the high-pressure connection to the high-pressure inlet of the flow area.

2. The fuel distributor as recited in claim 1, wherein the fuel distributor is a fuel distribution rail for a mixture-compressing, spark-ignited compression engine.

3. The fuel distributor as recited in claim 1, wherein the base body is a tubular base body and the divider formed by the insert element in the inflow area separates the inflow area at least in sections from the damping area viewed in a profile perpendicular to a longitudinal axis of the base body.

4. The fuel distributor as recited in claim 1, wherein at least one through opening, at which the inflow area is locally connected to the damping area, is provided at the insert element.

5. The fuel distributor as recited in claim 1, wherein the insert element is situated in the base body in such a way that a connection of the inflow area to the damping area takes place at least locally between an inner wall of the base body and the insert element.

6. The fuel distributor as recited in claim 1, wherein the insert element is connected at least locally to an inner wall of the base body.

7. The fuel distributor as recited in claim 1, wherein the insert element is configured in such a way that the insert element rests at least predominantly at an inner wall of the base body at least at the inflow area.

8. The fuel distributor as recited in claim 7, wherein the insert element has an outer side, at which the insert element rests partially at the inner wall of the base body and/or the insert element has an outer wall facing the inflow area in one part, the insert element resting at the inner wall of the base body in other parts of the outer wall.

9. The fuel distributor as recited in claim 1, wherein the base body is a tubular base body, a high-pressure connection is situated at an end piece provided at an end of the tubular base body, and an eccentric fuel guidance to the high-pressure inlet of the inflow area is in the end piece.

* * * * *